United States Patent [19]

Peabody et al.

[11] 3,979,789

[45] Sept. 14, 1976

[54] DUST CONTROL FOR POWER FLOOR TREATING APPARATUS

[75] Inventors: Ralph C. Peabody, Brooklyn Center; Robert D. Hennessey, Golden Valley, both of Minn.

[73] Assignee: Tennant Company, Minneapolis, Minn.

[22] Filed: Dec. 10, 1973

[21] Appl. No.: 423,294

Related U.S. Application Data

[63] Continuation-in-part of Ser. No. 341,973, March 16, 1973, Pat. No. 3,892,003.

[52] U.S. Cl. ..... 15/349; 15/340

[51] Int. Cl.[2] ..... A47L 5/30; A47L 9/10

[58] Field of Search ..... 15/340, 347, 349, 373

[56] References Cited

UNITED STATES PATENTS

| | | | |
|---|---|---|---|
| 2,701,377 | 2/1955 | Luksch et al. | 15/349 X |
| 3,006,021 | 10/1961 | Patch | 15/349 X |
| 3,512,206 | 5/1970 | Young | 15/340 X |
| 3,639,940 | 2/1972 | Carlson et al. | 15/349 X |
| 3,824,771 | 7/1974 | Williams | 15/340 X |

*Primary Examiner*—Christopher K. Moore
*Attorney, Agent, or Firm*—Orrin M. Haugen

[57] ABSTRACT

A power floor treating assembly having an improved arrangement for housing and mounting the rotary brush or other floor maintenance tool for sealing the brush or tool enclosure from ambient. The apparatus includes a main frame along with a powered output shaft for driving the rotary brush. Housing means are coupled to the frame to define a brush or rotary tool receiving enclosure, along with a solid debris receiving chamber which is in communication with the brush receiving enclosure. The rotary tool receiving enclosure is an enclosed sector having generally closed ends with transverse walls including a top wall, side walls, and with an open bottom. In addition, a solid-air separator is provided with a fluid evacuation port being formed in one of the brush enclosure walls. A baffle is provided within the rotary tool receiving enclosure, with the baffle means being disposed adjacent one of the transverse walls, and extending generally parallel to the axis of the rotary tool, with the location of the baffle being generally between the fluid evacuation port and the bottom opening in the rotary tool receiving enclosure.

9 Claims, 12 Drawing Figures

DUST CONTROL FOR POWER FLOOR TREATING APPARATUS

CROSS-REFERENCE TO RELATED APPLICATIONS

The present application is a continuation-in-part of co-pending application, Ser. No. 341,973, now U.S. Pat. No. 3,892,003, filed Mar. 16, 1973, entitled "Power Floor Treating Apparatus", and assigned to the same assignee as the present application.

BACKGROUND OF THE INVENTION

The present invention relates generally to an improved floor treating apparatus, such as a power floor sweeping apparatus, having improved means for mounting and housing the floor treating member within the structure, with the apparatus particularly providing an improved housing arrangement which forms an enclosure for floor maintenance tools such as rotary brushes. This enclosure includes a fluid evacuation port which is in communication with a remote evacuated solid-air separation chamber, with baffle means being interposed between this fluid evacuation port and the floor exposing opening disposed at the base or bottom of the brush receiving enclosure. The apparatus further provides a mounting arrangement which permits the floor maintenance tool, such as a rotary cylindrical brush or broom, to be free-floating in its running contact with the working surface, and also provides for a significant reduction in the transfer of vibrational energy from the brush to the main frame.

Power driven floor treating apparatus such as power floor sweepers, as well as other maintenance tools such as polishing rolls for tile and cement floors, and carpet cleaning devices are in wide use. These devices find particular utility in cleaning of floors in commercial establishments, such as office buildings, factories, parking ramps and the like. Sweeping devices are normally employed for removal of dust, dirt, as well as other debris from the floor surfaces, these devices typically employing a rotary cylindrical brush which is adapted to move large items of debris from the floor or working surface into a debris receiving hopper. In order to reduce the amount of dust raised during the floor treating operation, the housing for the floor maintenance tool is normally vacuumized and sealed with flexible base seals so as to isolate the housing and provide for a controlled flow of dust-ladened air from the housing into a separation chamber with minimal dusting. The chamber is vacuumized, with a dust or solids-removing filter being interposed within the separation chamber at a point between the floor treating member housing and the vacuum exhaust. In order to reduce the quantity of dust being raised in the ambient, seal means are provided which assist in isolating the housing for the floor treating member from the ambient.

In the operation of a power floor sweeping device, typically the larger solids are moved or otherwise transferred from the floor surface into the solid debris receiving hopper. The lighter solids are normally entrained in the air, and are ultimately moved through the action of the vacuum system into a solids-air separation chamber. For proper operation of the device and for minimal dusting of the ambient, it would appear relatively simple to increase the capacity of the vacuum system and thus move a greater quantity of air and entrained solids therethrough. Regretably, however, as this capacity or volume is increased, more and larger solid particles are drawn to the vacuum system, and the filter becomes increasingly prone to clogging, with the dirt particles tending to cling to the surface of the filter. Therefore, most effective operation is achieved by utilizing other means for dust control, while maintaining the capacity or volume of air being moved through the vacuum system at a practical minimum, consistent with other operating parameters. By careful design of the chamber, and by careful selection of operating parameters, a practical balance may be achieved between operation of the vacuum system and minimizing both the volume of air being moved through the vacuum system, while minimizing dusting of the device to the ambient.

In the system of the present invention, a baffle system has been provided for the brush or maintenance tool enclosure which reduces dusting tendencies, and renders it possible to operate a power sweeping apparatus utilizing a minimal quantity or volume of air in the solids-air separation portion of the system, with one or more baffles being provided.

In the normal operation and servicing of floor treating apparatus, particularly floor sweeping devices employing a rotating cylindrical brush, it is frequently necessary to remove the brush from the assembly. In certain devices of this type, brush removal is achieved only with a certain degree of difficulty, however in one embodiment of the apparatus of the present invention, a structure is provided permitting removal of the floor treating member from the assembly with relative ease.

As has been indicated, rotation of the floor treating member is required in order to achieve the desired results, with rotation of the cylindrical brush being necessary for removing debris from the floor surface. At the present time, most floor treating devices employ a mounting system for the brush or other implement which is at a fixed elevation relative to the working surface. In accordance with one embodiment of the apparatus of the present invention, however, the floor maintenance tool or implement is arranged to be free-floating in its running contact with that surface, thus providing for enhanced treatment. One feature of such a mounting arrangement is that the peripheral surface of the rotary brush may be maintained at a relatively constant distance from the surface of the baffle means which is arranged across the extent of the brush retaining enclosure. Also, the floor treating member or implement in the form of a cylindrical brush is mounted within an assembly which is suspended from the main frame by a resilient, flexible, but non-stretchable web, this web partially absorbing and thus impeding the transfer of certain vibrational energy from the floor treating member to the main frame. It has been found that this impedance of transfer of energy from the floor treating member is desirable for the operator.

SUMMARY OF THE INVENTION

In accordance with the present invention, a floor treating device such as a sweeper is provided having improved means for controlling the raising of dust in the area of machine operation. In another aspect of the invention, an improved system is provided for mounting a rotating brush within the brush receiving enclosure. In one operative embodiment, the cylindrical brush is mounted within a brush receiving enclosure in the assembly and is suspended from the main frame by a resilient flexible, but non-stretchable web, with the resilient web forming a free-floating pivot permitting the floor treating member to be free-floating in its running contact with the working surface. Briefly, in such an embodiment, the rotary brush mounting assembly includes a transverse support member with a pair of laterally disposed arms extending from the opposed ends thereof, and with each of the arms having an inwardly extending boss means for receiving and drivingly engaging the floor treating member. While both of the laterally disposed arms are longitudinally rigid, one of the arms is laterally flexible so as to permit ease of spreading of the arms for removal of the floor treating member from the mounting assembly. Also, in this embodiment, a separation chamber is preferably provided to remove dust from dust-ladened air, and a filter is provided within the separation chamber, with the mounting frame for the filter being anchored to the main frame. Also, means are provided to enable the operator to gain easy access to the interior of the separation chamber to provide for removal or cleaning of the filter surface.

Therefore, it is a primary object of the present invention to provide an improved housing and mounting system for a rotary brush or other floor maintenance tool with improved dust control being provided for the assembly.

It is a further object of the present invention to provide an improved means for mounting a floor maintenance tool such as a cylindrical brush within the structure of a floor treating apparatus.

It is a further object of the present invention to provide improved dust control for a power floor sweeping apparatus which may employ a mounting means for the brush permitting free-floating of the brush in its running contact with the working surface.

It is yet a further object of the present invention to provide an improved power floor sweeping apparatus having means for controlling the generation of dust in the vicinity of the apparatus, while permitting a substantial reduction in the volume of air which is passed through the solids-air separation chamber.

It is yet a further object of the present invention to provide a floor treating apparatus having a baffle arranged in the brush housing to provide a dynamic seal between the peripheral surface of the brush and the brush retaining enclosure or housing so as to isolate that portion of the brush retaining enclosure from which dust-ladened air is being evacuated from that portion of the enclosure which is adjacent the opening to ambient.

It is still a further object of the present invention to provide a floor treating apparatus having improved means for mounting the floor treating member to the structure, with this mounting arrangement utilizing a resilient web to suspend the floor treating member from the main frame by a resilient web so as to provide for relatively constant spacing between the outer edge surface of the baffle and the brush periphery, as well as to reduce the transfer of certain vibrational energy from the floor treating member to the main frame.

Other and further objects of the present invention will become apparent to those skilled in the art upon a study of the following specification, appended claims, and accompanying drawings.

DESCRIPTION OF THE PREFERRED EMBODIMENT

Figure 1:
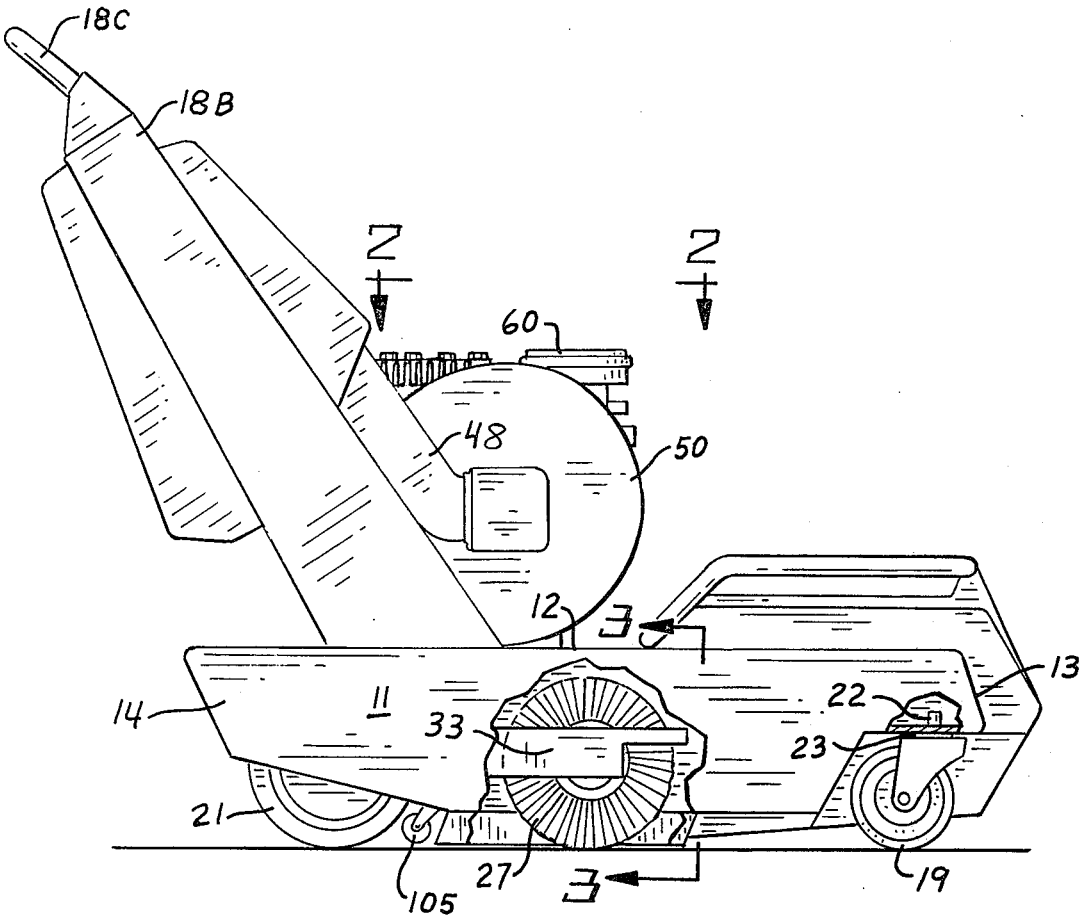
FIG. 1 is a side elevational view, of the improved floor treating apparatus of the present invention in the form of a floor sweeping apparatus, with portions of the housing being cut away so as to illustrate details of the brush enclosure.
Figure 4:
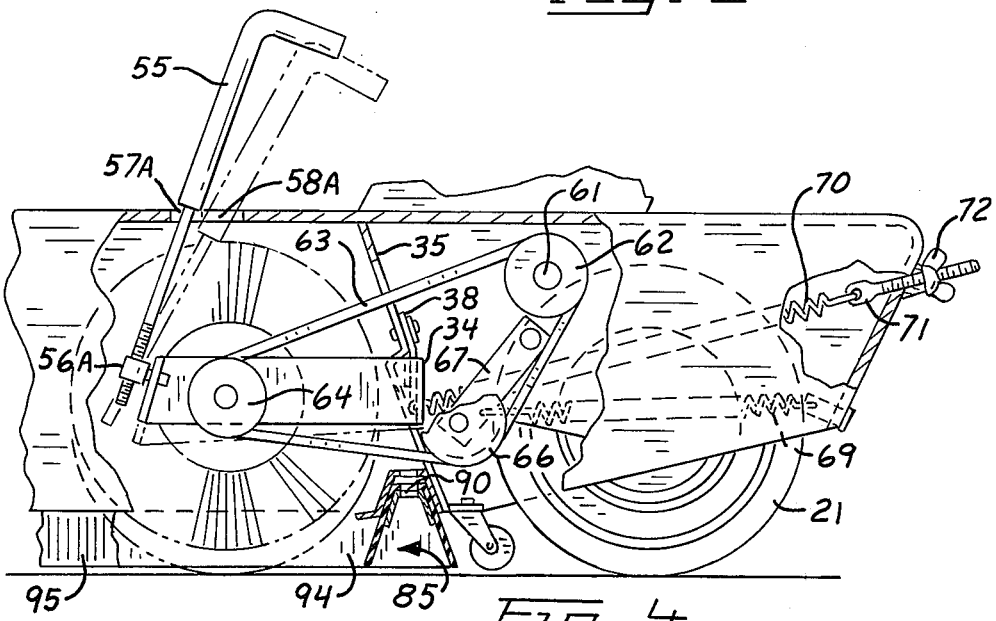
FIG. 4 is a fragmentary side elevational view, partially broken away and partially in section, illustrating details of the brush suspension and drive system.
Figure 5:
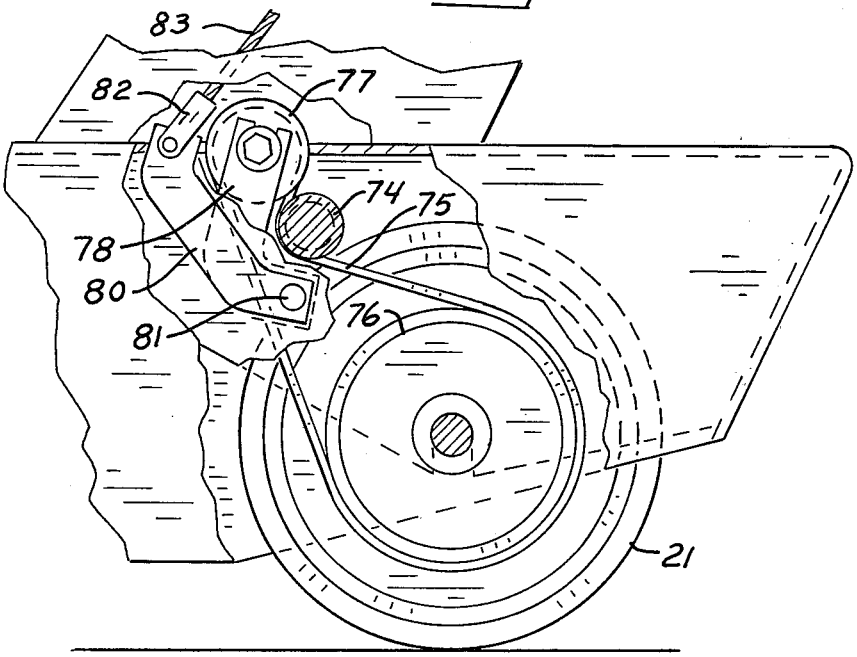
FIG. 5 is a fragmentary side elevational view, partially broken away and partially in section, and illustrating the drive means for delivering power to the drive wheel of the apparatus.
Figure 6:
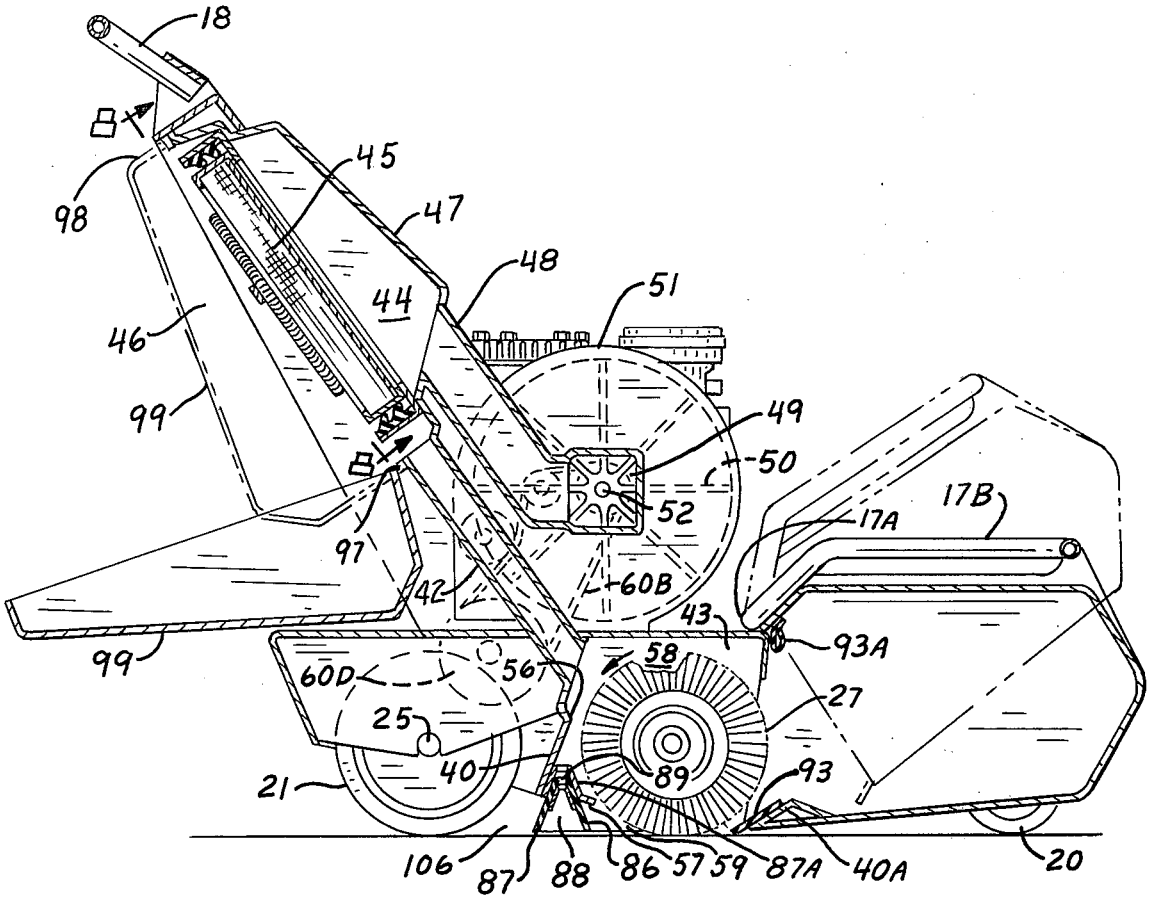
FIG. 6 is a vertical sectional view of the floor sweeping apparatus as illustrated in FIG. 1, and showing the solid-air separation chamber in opened disposition in solid line, and in closed disposition in phantom, with this view being taken generally along the central axis of the device.

In accordance with that embodiment of the present invention shown in FIGS. 1–9 inclusive, the floor sweeping apparatus generally designated 10 includes a frame means 11 in the form of a structural housing including a top panel 12, a front panel 13, a rear panel 14, and a pair of laterally opposed side panels 15 and 16. The housing further is arranged to receive a removable debris receiving hopper 17, as is illustrated in FIG. 6. The hopper is appropriately sealed into contacat with the remaining portions of the structure, as is apparent from the showing in FIG. 6. A control handle 18 is provided, with handle 18 having a pair of laterally disposed arms 18A and 18B secured to top panel 12 (FIG. 3) of the frame means 11, and with a gripping section being provided as at 18C (FIG 1). The support wheels include a pair of forwardly disposed castors 19 and 20, and a rearwardly disposed drive wheel 21. The forwardly disposed castors are adapted for rotation, as is conventional, by means of mounting plate or post as at 22, the castors being secured to a main support plate 23, as indicated in FIG. 1. Rear drive wheel 21 is mounted for rotation on axle shaft 25, with power being delivered to drive wheel 21 by means of a drive assembly to be described in further detail hereinafter. As is apparent in the showing in FIG. 3, drive wheel 21 is offset from the central axis of the structure so as to provide for a proper balance in the device. The concentration of weight due to the location of motor 60 and other heavy components render the off-setting of wheel 21 desirable.

Figure 2:
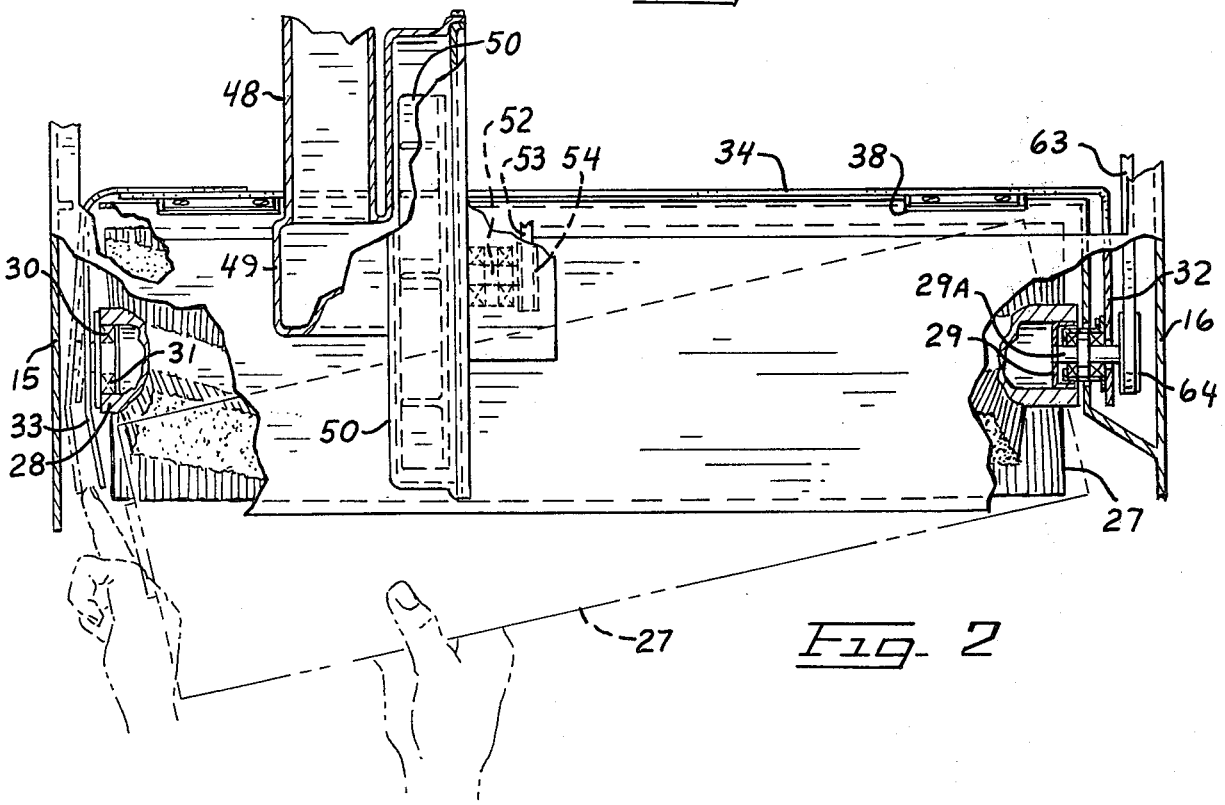
FIG. 2 is a detail sectional view taken along the line and in the direction of the arrows 2—2 of FIG. 1 and illustrating, partially in phantom, the manner in which brush removal is accomplished.
Figure 3:
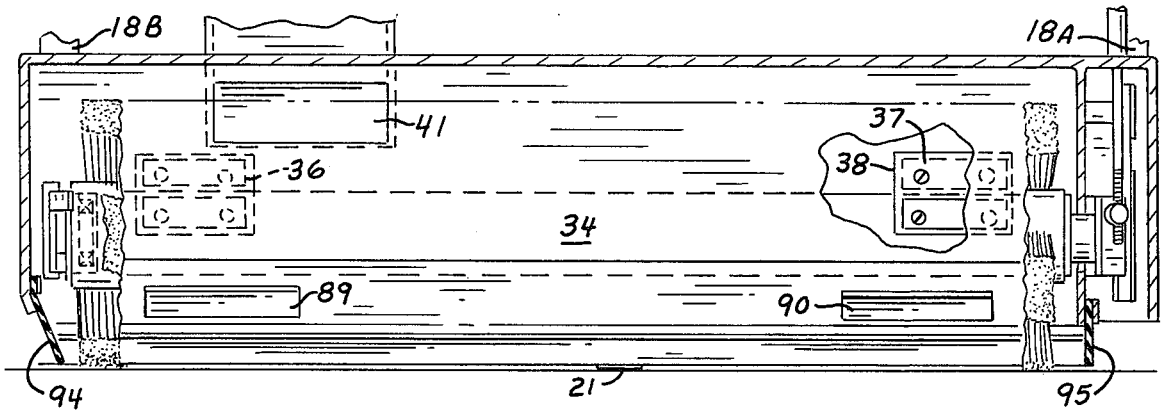
FIG. 3 is a vertical sectional view of the floor sweeping apparatus as illustrated in FIG. 1.

As is apparent from the drawings, the apparatus includes a floor treating means or maintenance tool in the form of a cylindrical rotary brush 27 which is journaled for axial rotation within the frame means. The details of the mounting of the cylindrical brush 27 which functions as an implement suspension means are best illustrated in FIGS. 2, 3 and 4, it being noted that the cylindrical brush 27 includes a core 28 which is arranged to receive the hubs 29 and 30 therewithin, with hub 29 preferably being positively engaged within core 28 to provide for positive driving of brush 27. A key or a radial extending rib may be employed if desired with a matching receiving slot being formed in the brush core. For reduction of friction, the core engaging portion of boss 30 is preferably hexagonal. As is apparent in the illustrations of FIGS. 2 and 3, hubs 29 and 30 are arranged along a common axis and support cylindrical brush 27. In order to provide for freedom of rotation of hubs 29 and 30, journal bearings are provided in the mounts as at 31. Also, as is apparent in FIGS. 2 and 3, hubs 29 and 30 are supported on laterally disposed mounting bracket 32 and arm 33. Support for bracket 32 and arm 33 is obtained from plate 34 which is hingedly secured to frame plate extension 35 as at 36 and 37, plate 34 thus being a transverse support member for bracket 32 and arm 33. Hinge elements 36 and 37 utilize a flexible coupling web such as a web of polypropylene as is illustrated at 38, this web providing hinged support or coupling between plates 34 and 35 and thus permitting free-floating of brush 27 while in use. The flexible web support which may alternatively be fabricated from vinyl plastic, rubber, or the like, provides a free-floating support about a "support axis". This suspension system has been found to reduce the amount of vibratory energy which is transferred from the rotary cylindrical brush 27 to the remaining portions of the frame.

As is apparent in the drawings, the brush enclosure includes a forward wall such as wall 13 forming a portion of the debris receiving hopper, a rear transverse wall at 40, and opposed side walls 15 and 16. As is apparent from the view of FIG. 6, a further forwardly disposed generally transversely arranged wall segment is shown as at 40A, with a portion of this wall segment being occupied by resilient seal member 93, discussed more in detail hereinafter. A fluid receiving port for air and suspended dust or debris is formed in wall 40 as at 41, and conduit means, such as the conduit 42 extends from the brush receiving enclosure 43 to the air suspended dust receiving chamber or enclosure generally designated 44. The air suspended dust receiving chamber 44 acts as a solid-air separating chamber with filter 45 being employed to separate the incoming portion of the chamber as at 46 from the discharge portion of the chamber as at 47. Exhaust conduit 48 extends from chamber segment 47 to exhaust port 49 which provides communication between conduit 48 and impeller 50. Impeller 50 housed within casing 51 is utilized to generate fluid flow from the enclosure 43 to the air suspended dust receiving chamber 44. Impeller 50 is mounted on shaft 52, with rotational energy being delivered to the impeller by means of belt 53 driving pulley 54, pulley 54 being fast on shaft 52. Suitable journal bearings are provided as illustrated in FIG. 2 of the drawings. Belt 53 is driven from output or countershaft 51 which is coupled to the drive shaft 60A of motor 60, through belt 60B and pulleys 60C and 60D. The housing for the floor treating means is preferably vacuumized. The reduction of pressure within this housing reduces the quantity of dust which is raised in the working area, and is accordingly normally preferred for apparatus of this type.

With attention being directed to FIGS. 4 and 6, it will be seen that wall 40 is provided with a baffle zone as at 56, with this baffle having a forward abutment surface which is arranged in close running clearance with the peripheral surface of rotary brush 27. Although a single baffle may be sufficient, a second baffle is provided forwardly of baffle 56 in the arcuate direction of travel of rotary brush 27, with this baffle being shown at 57. During operation of the device, therefore, it will be appreciated that a dynamic seal is provided by the close running clearance existing between the periphery of the brush and the baffle surfaces 56 and 57, thereby generally isolating the upper portion of the brush receiving enclosure, as at 58, from the lower portion thereof as at 59.

Attention is now directed to FIGS. 2, 3 and 4 of the drawings for a discussion of the suspension and support system for the rotary brush assembly. As is apparent in this view, arm 33 supports hub 30 which, in turn, is received within the core of cylindrical rotary brush 27. The axial height of brush 27 when raised for transport or other reasons is adjustably controlled by means of threaded control shaft 55 which engages internally threaded coupling 56A, and which is provided with a support step or collar as at 57A for engaging a key-hole opening in frame or housing top panel 12. Key-hole bore is formed in top panel 12 as at 58A for receiving the shank of member 55. The phantom view of lever 55 (FIG. 4) is provided to illustrate the free-floating lower or running disposition of cylindrical rotary brush 27, as is also illustrated in phantom in FIG. 4. As is apparent, the solid lines of FIG. 4 indicate the disposition of the brush when in transport position.

Motor 60 is provided in order to deliver power for imparting axial rotation to the cylindrical brush 27. The derive shaft 60A of motor 60 drives output or countershaft 61 (FIG. 4) through a belt with brush drive pulley 62 being fast on shaft 61. Belt 63 is utilized to deliver power to pulley 64 which is, in turn, fast on shaft 29A of hub 29. Idler pulley 66 is provided for maintaining desired tension in belt 63, with idler 66 being mounted on link 67 which is pivotally secured to the frame on shaft 68. Adjustable spring member 69 has one end coupled to link 67, with its other end being secured to the frame. A second spring is shown at 70 for maintaining or regulating the amount of down-pressure on brush 27. Spring 70 has its forward end secured to support plate 34, with its rearward end being adjustably coupled to the frame through eye-bolt 71. The position of eye-bolt 71 is determined by wing nut 72. As is apparent from the description in FIG. 4, the torque delivered to pulley 64 by belt 63 applies an upwardly directed force on arms 32 and 33, thus tending to lift brush 27 modestly in response to increase in rotational resistance between the brush and the surface being worked.

With continued attention being directed to FIG. 4, it will be observed that the pivot point for the plate 34 is dispoed radially outwardly, but closely adjacent the outward extension of baffle 56. Thus, as the brush wears during normal use, the pivotal support mechanism will rock or arcuately shift the periphery of the rotary brush toward the baffle, and thus maintain a substantially constant clearance.

Figure 7:
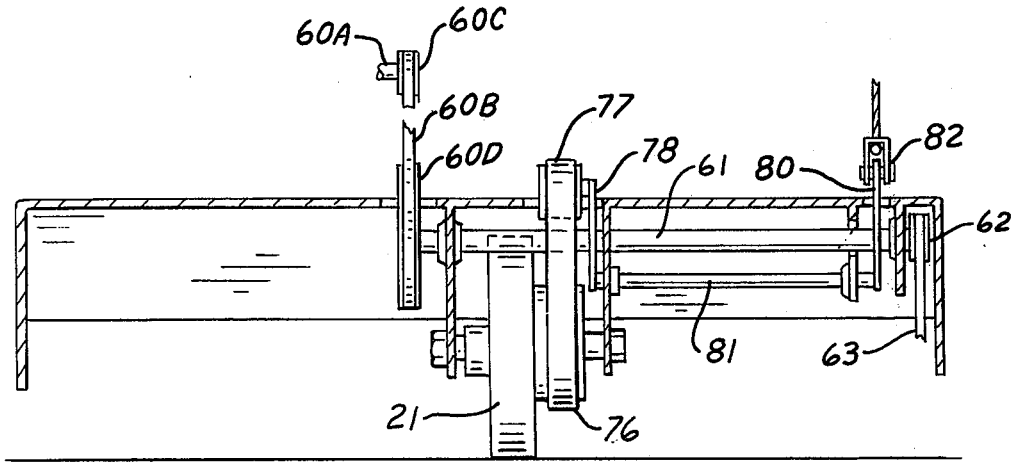
FIg. 7 is a vertical sectional view taken along the line and in the direction of arrows 7—7 of FIG. 1.
Figure 8:
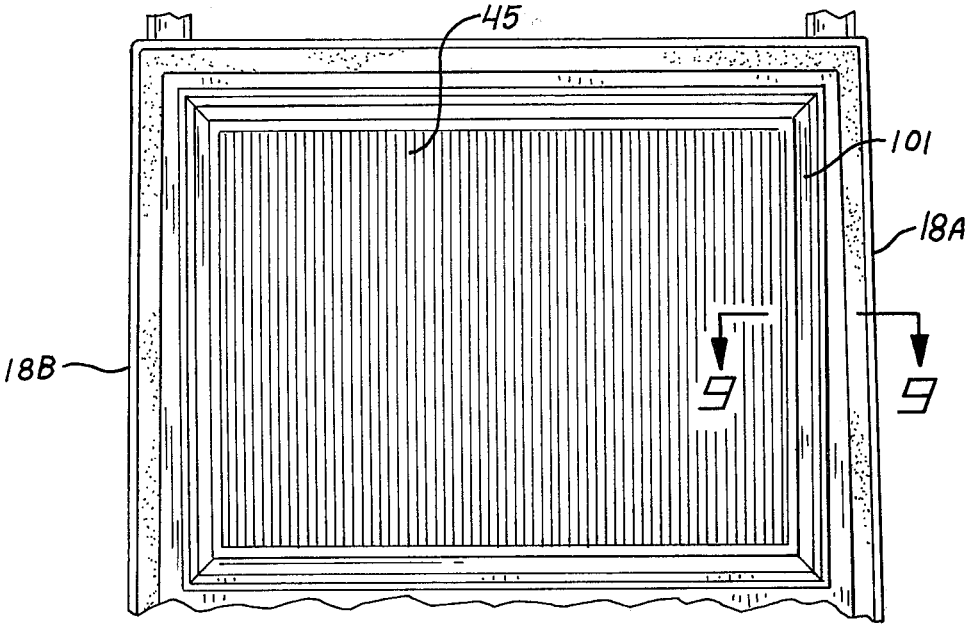
FIG. 8 is a detail sectional view taken along the line and in the direction of the arrows 8—8 of FIG. 6, and illustrating the manner in which the filter structure is mounted within the confines of the solid-air separation chamber.

Attention is now directed to FIGS. 5 and 7 of the drawings for an illustration of the drive means. Drive wheel 21 is driven from shaft 61 by means of pulley 74, pulley 74 being fast on shaft 61, with belt 75 engaging pulleys 74 and 76. Adjustable idler pulley 77 is mounted for rotation on a shaft secured to crank arm 78, arm 78 being secured to bracket 80. Bracket 80 and arm 78 are pivotally secured to pin 81. Bifurcated coupling 82 is provided on cable 83 for controlling the disposition of idler 77 and the ultimate tension in belt 75. In the position illustrated in FIG. 5, the arrangement is in "drive" disposition, and counter-clockwise motion of bracket 80 about pivot pin 81 will reduce tension in drive belt 75, thus permitting the unit to rest with the engine at idle.

Attention is now directed to the details of the sealing means illustrated in FIGS. 3 and 6. Skirt means generally designated 85 are preferably provided in this embodiment, and are coupled to the wall means at the rear of chamber 43. Skirt means 85, which isolate enclosure 43 from the ambient, include first and second tandomly arranged spaced apart sealing elements 86 and 87. These sealing elements 86 and 87 are in inverted "U" configuration and held with clamp 87A and are cooperatively arranged to form a seal pair and define a sealing chamber 88 therebetween. A pair of vents are provided as at 89 and 90 (shown disposed along the forward surface in FIG. 3, and alternately along the upper surface in FIG. 6) for providing gaseous fluid communication between the chamber 43 and the sealing chamber 88. The combined area of vents 89 and 90, when this type of seal is employed, is preferably substantially equal to the area of port 41. As is apparent in the drawings, vents 89 and 90 are preferably spaced apart and disposed generally adjacent the opposed side walls 15 and 16 of chamber 43. Also, these vents are formed in the skirt which is adjacent that portion of the brush which, in its normal running disposition, forces debris thereagainst.

In addition to the stationary seal means 86 and 87, a further forward stationary seal is provided as at 93 for providing further isolation of the chamber 43 from ambient, seal means 93 also providing a gasket along wall 40A for debris receiving hopper 17. An upper forward seal is shown at 93A, this seal performing a similar gasketing function. Lateral seals are also provided such as those illustrated at 94 and 95 in FIG. 3, with seal member 94 being turned inwardly in order to achieve close running clearance with the ends of rotary brush 27. This arrangement provides close running clearance between the ends of brush 27, particularly the left end as viewed in FIG. 3, and the lateral side of the unit, such as wall 15.

Particular attention is now directed to FIG. 2 of the drawings for a detailed discussion of the manner in which brush 27 may be removed from that embodiment of the assembly. As has been previously indicated, brush 27 is provided with a core 28 which is received on hubs 29 and 30 of the opposed bosses. Arm 33 is resilient and is inwardly biased so as to firmly engage and retain brush 27 in operating disposition. For removal of brush 27, the operator will press arm 33 outwardly, as is illustrated in phantom in FIG. 2, so as to disengage the surface of hub or boss 30 from the core 28 of brush 27, thereby permitting the brush to be dropped.

While the structure has been illustrated as being provided with a gasoline engine 60, it will be appreciated that alternate forms of power may be provided such as by electrical motor means, battery power means, or the like.

In the air suspended dust receiving chamber 44, hinge means are provided as at 97 for enabling the operator to open the chamber and remove the cover wall 99 to dump accumulated debris therefrom. A lock is provided as at 98 to ensure enclosure of chamber wall 99 when the unit is in operation. As is apparent in the drawings, filter 45 is received within the confines of a gasketed perimeter as at 100 (FIG. 9), with the gasket employing a pair of generally parallelly disposed lips 101 and 102 for making contact with the outer periphery 103 of filter 45. It has been found that the positioning of filter 45 within the confines of arms 18A and 18B of handle 18 enhances the delivery of vibratory energy to the filter, and thus tends to render it self-cleaning while the unit is in operation. Also, the filter element per se is generally upstanding, while being disposed at an acute angle to the horizontal, and with the dirt-receiving side of the filter being directed generally downwardly. This arrangement permits any trapped debris to be released from the surface of the filter during normal operation, with the release being accomplished by the delivery of vibratory forces to the filter element. In this fashion, therefore, the filter tends to be self-cleaning and release of debris is possible because of the lower volume and capacity requirements of the vacuum means. The filter material may be any of the conventional materials such as paper, fabric, or the like.

The reduction in volume and capacity of the system provides an arrangement whereby less dust is carried to the filter. This dust, even when ultimately striking the filter, is not held tightly against the surface, nor is it impinged directly into the pores of the filter media. This feature makes the media more readily cleanable. It will be further observed that the air flow into the separator chamber is such that the baffle arrangement within the separator chamber causes the air to approach the surface of the filter at generally right angles thereto. Thus, a greater portion of the filter area is effective in filtering. Also, since laminar flow is normally present under typical operating conditions, less dust is caused to impinge upon the filter surface.

In addition to these particular or specific advantages, it will also be appreciated that a reduction in air flow requirements permits the device to be functional with lower power requirements.

Hopper 17 is also removable from the assembly. Large items of debris collected in hopper 17 are conveniently transported to a suitable place of disposal, with hopper 17 being removed by either upwrd lifting from the structure, or by a counter-clockwise pivotal motion of hopper 17 about end portions 17A of gripping rod 17B.

In the embodiment of FIGS. 1–9 inclusive, for purposes of operating stability, while the three support wheels including castors 19 and 20 and drive wheel 21 are generally sufficient, additional support may be made available to the structure by means of elevated castors or support wheels 105 and 106. These units may assist in preventing the unit from tipping sufficiently far from its normal running disposition so as to protect the integrity of seals 86 and 87.

The arrangement of the drive wheel and castor support wheels is such that the device has high maneuverability and great ease of handling. The structure is light in weight and does not require heavy drive means, mechanisms, or the like.

The simplicity of the structure is such that a device may be fabricated from a minimal number of components. In this connection, design simplicity permits the structure to be manufactured with significantly fewer component parts than may otherwise be required for conventional commercial devices of this type, with a reduction of approximately 43 percent in components being realistically achieved.

Figure 9A:
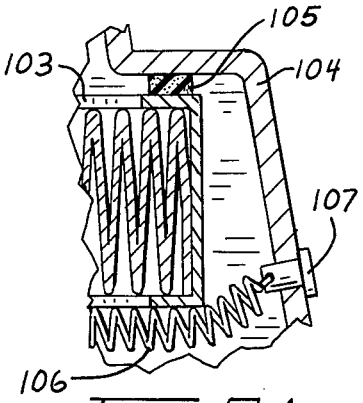
FIG. 9A is a detail sectional view similar to FIG. 9, and illustrating a modified form of filter seal and retention system.
Figure 9:
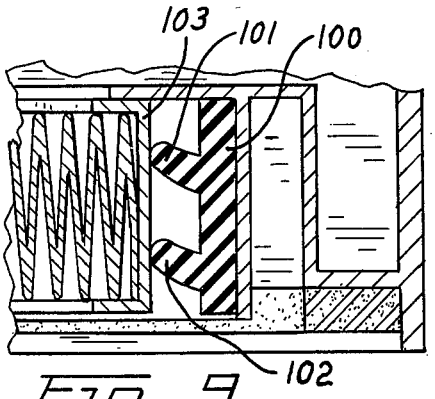
FIG. 9 is a detail vertical sectional view taken along the line and in the direction of the arrows 9—9 of FIG. 8, and illustrating the details of the seal device which is utilized to retain the filter assembly in position within the solid-air separation chamber.

Attention is now directed to FIG. 9A wherein a modified form of filter seal arrangement is illustrated. In this assembly, frame member 104 is utilized to receive filter 103, with filter 103 having a surface seal 105 disposed about the periphery thereof, for sealing the filter within the confines of frame 104. In order to retain filter 103 in place, tension spring member 105 is provided which is secured or otherwise coupled to the frame by means of the clevis pin or anchor member 107.

Figure 10:
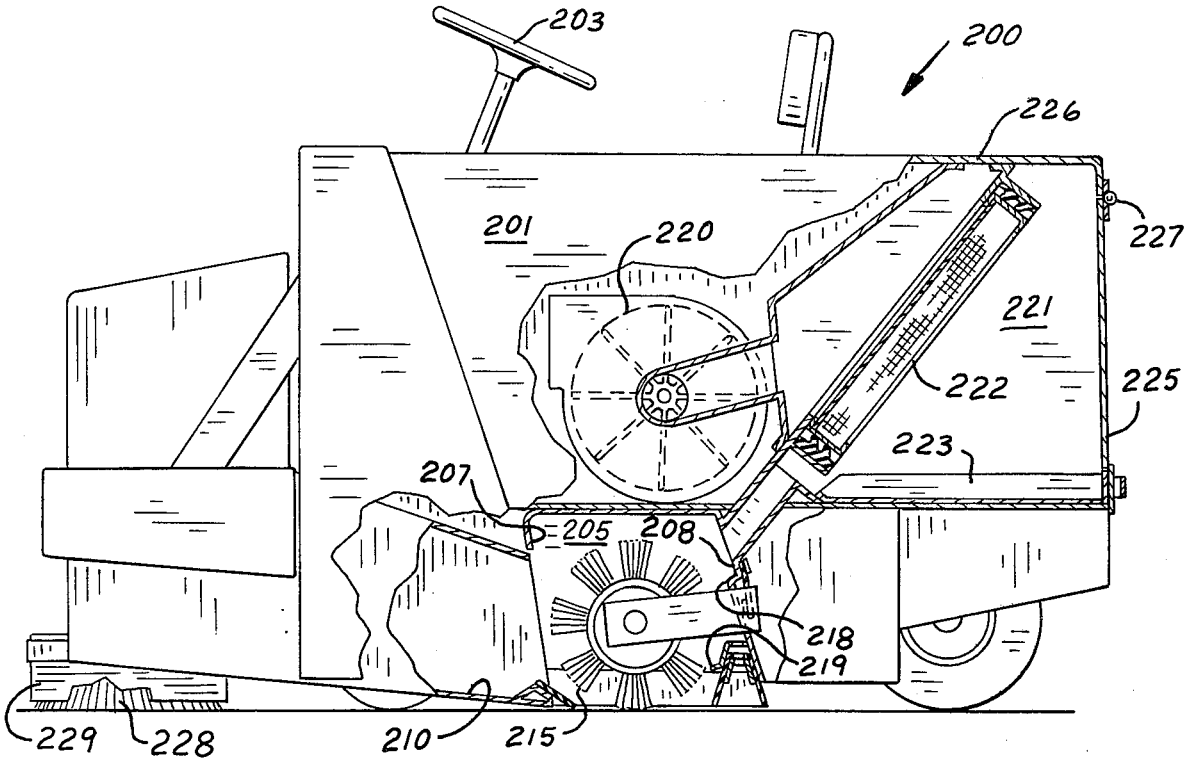
FIG. 10 is a schematic illustration of a modified form of floor treating apparatus wherein a riden unit is provided utilizing the improved brush housing and mounting arrangements of the present invention.

The materials of construction to be utilized for the device illustrated in FIGS. 1–9, as well as that in FIG. 10 are conventional. For example, seals 86 and 87 in FIGS. 1–9 are preferably fabricated of reinforced rubber or the like. Such seal material is, of course, commercially available and any of a variety of resilient flexible materials may be employed for this purpose. The polypropylene web for the suspension system is preferably a ⅛ inch web with a total web length of about 8 inches being sufficient for most conventional machines with brushes of up to 21 or 24 inch length.

As has been indicated hereinabove, this web material for the suspension may also be fabricated from other synthetic resin materials such as vinyls or the like. Also, rubber may be employed as a suitable material, with rubber of, for example, 50 durometer being suitable. The practical requirement for this hinge or suspension material is that it be sufficiently durable to carry the load, but yet sufficiently flexible so as to permit the brush to be free-floating during its operational cycle. The frame is preferably fabricated from conventional steel with sheet metal or the like being used for the housing members.

Attention is now directed to FIG. 10 of the drawings wherein a second embodiment of a floor treating apparatus is shown, with the structure being shown generally at 200, and including a vehicle frame or chassis 201 propelled by an engine (not shown) and directionally controlled by steering mechanism shown generally at 203. The frame means includes a brush retaining enclosure as shown generally at 205, which includes a top panel 206, a front panel 207, along with a rear panel 208. The structure is arranged to receive a debris receiving hopper 210, particularly as is illustrated. This hopper is also appropriately sealed into contact with the remaining portions of the structure, particularly to the brush receiving enclosure, as is conventional. The apparatus includes a cylindrical rotary brush 215 which is journaled for axial rotation within the frame means. The details of the mounting of cylindrical brush 215 are preferably the same as that illustrated in the structure of FIGS. 1–9, and reference is made to the details of that embodiment for the mounting details herein.

The brush receiving enclosure, as illustrated in FIG. 10, also includes a baffle as at 218, along with a second baffle element as at 219. As has been indicated hereinabove, baffle 219 is not specifically required for isolation purposes, however its presence has been found to enhance the performance of the device.

It will be noted that the floor treating apparatus 200 includes fan means as shown at 220 which induces a vacuum within solid-air separation chamber generally designated 221, with filter 222 being interposed between the vacuum means 220 and the brush retaining enclosure 205. A dust drawer, for appropriate removal of solid debris, is shown at 223. Also, in order to appropriately change or service the filter element 222, a pivotal panel or wall 225 is provided, which is hingedly secured to top or upper wall 226 along hinge 227. Also, as is apparent from the cutaway portion at the forward end of apparatus 200, side brush 228 is provided, with this brush having a shroud 229 disposed thereabout. Shroud 229 which may provide an enclosure capable of being coupled to a vacuumized dust control system assists in reducing dusting from the operation of side brush 228.

Figure 11:
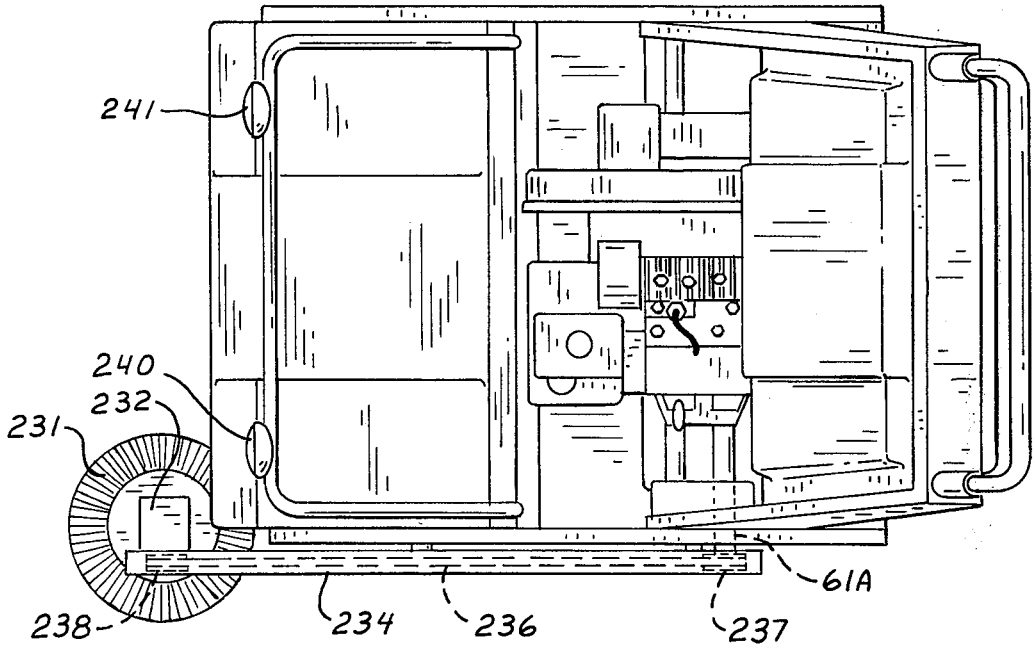
FIG. 11 is a top plan view of a modified floor treating apparatus employing a side brush at the forward end thereof.

The floor treating apparatus illustrated in FIG. 11 is essentially the same as that of FIGS. 1–9, with certain added features being provided. In this embodiment, side brush assembly generally designated 230 is provided having a side brush member 231 operatively coupled thereto. Transmission housing 232 is also provided for delivering rotary motion to brush 231 from the belt drive assembly described hereinafter. Assembly 230 is supported by mounting member or bracket 234 which also conveniently functions as a belt guard. Belt 236 is shown in the drawing, with belt 236 being driven by drive pulley 237. Belt 236 is also in operative association with pulley 238 which, in turn, provides for rotary motion through a friction drive or the like in transmission 232. In order to obtain rotary motion for pulley 237, shaft extension 61A is provided which extends from counter-shaft 61 in the main portions of the assembly.

For certain operations, it is frequently desirable to have lights available for the power sweeper apparatus, with lights being illustrated herein at 240 and 241.

It will be further noted that the debris receiving hopper in each of the embodiments discussed hereinabove is in actual and full communication with the brush receiving enclosure. Thus, the port which provides communication between the filter chamber and the brush receiving enclosure is in actual communication with the entire internal portions of the apparatus, including the upper portion of the brush receiving enclosure, as well as the debris receiving hopper. The dynamic seals which are formed by virtue of the proximity of the brush periphery to the baffles, such as baffle 56 in the embodiment of FIGS. 1–9, and baffle 218 in the embodiment of FIG. 10, effectively provide a division or separation of zones within the brush receiving enclosure, with it appearing that a zone of increased or super-pressure is available in the upper portions of the enclosure, and with this zone brush-induced super-pressure being confined and defined by passage of the brush through the zone forming the dynamic seal with the baffle element. It will be appreciated further, however, that the zone of "super-pressure" is one which is tempered by virtue of the exposure of the vacuum in the system to this zone. Thus, what is being referred to herein is that effect provided by the "fan effect" of the brush as it rotates about its axis and the relationship of this effect to external dusting.

While the structure has been shown with a double skirt seal in the rear of the brush retaining enclosure, it will be appreciated that modified forms of seals may be employed such as, for example, a single seal element.

In a typical operational arrangement, the following pertinent data is provided:

| | |
|---|---|
| Brush size | 29" length, 8" diameter (when new) |
| Filter area | 42 sq. ft. |
| Brush speed | 400–700 rpm (typically 600 rpm) |
| Facial velocity (filter) | 2½ ft./minute (typically operational of 1 ft./minute) |
| Brush clearance (top of brush receiving enclosure) | 1⅛" |
| Area of inlet from brush receiving enclosure | 6¼ sq. in. |
| Area of filter discharge conduit to atmosphere | 7½ sq. in. |

With regard to the seals employed about the periphery of the brush receiving enclosure, the following data is presented as being typical:

| | |
|---|---|
| Edge clearance of seals including forward seal | approx. 1/16" |

The data presented relative to the brush diameter is the "as new" condition. It will be appreciated that for most practical operations, the brush will be permitted to wear down to a diameter of approximately 5½ inches without adversely affecting the performance of the device.

This data sets forth the operational parameters which emphasize the flow facial velocity through the filter medium. The operational parameters are such that the volumetric capacity of the filter is exceptionally low for the peripheral dimensions of the work surface exposing opening. In the present arrangement, the ratio has been found to be as low as 0.5 cfm/inch of peripheral seal.

A floor maintenance apparatus having a brush receiving enclosure designed pursuant to the present invention, and having a floor exposing opening which is approximately a rectangle 30 inches × 10 inches requires only a modest 40 cfm of air through the filter chamber. This low quantity of filter air is sufficient to prevent dusting during operation of the device.

By way of comparative data, typical power sweeping devices having conventional brush enclosures may require in excess of approximately 2.5 cfm/inch of seal in order to prevent dusting. The advantages to be derived in the filtering arrangement required for this system are substantial, that is, an extremely low facial velocity effectively reduces the volumetric capacity requirements of the filter, while correspondingly reducing the filter area requirements.

We claim:

1. Floor maintenance apparatus having a floor treating means including rotary brush means operatively coupled thereto and comprising, in combination:

a. a frame structure having support wheels coupled thereto, housing means coupled to said frame and defining a brush receiving enclosure with said enclosure having walls including a pair of opposed side walls arranged laterally of said enclosure, a solid debris receiving chamber in communication with said brush receiving enclosure, and a source of rotary power mounted on said frame and having a powered output shaft;

b. rotary brush suspension means coupled to said frame for journaled support of said rotary brush therewithin, said brush suspension means including first and second generally longitudinally extending laterally disposed support arms secured to said frame and being disposed adjacent said opposed side walls;

c. drive means coupled to said powered output shaft for imparting rotary motion to said rotary brush;

d. solid-air separation chamber means being provided to remove dust from dust-ladened air, and vacuum means in communication with said separation chamber and interposed between said separation chamber and ambient, conduit means extending between a port formed in said separation chamber and said vacuum means for establishing fluid communication between said separation chamber and said vacuum means, said solid-air separation chamber means being in communication with said brush receiving enclosure through a fluid receiving port formed in a wall of said brush receiving enclosure;

e. said brush receiving enclosure generally comprising an enclosed sector having generally closed ends and transverse walls and including a top wall and said opposed side walls with a bottom opening to define a work surface exposing opening, a solid debris transferring opening formed in one of said transverse walls for transfer of solid debris from said brush receiving enclosure to said solid debris receiving chamber disposed adjacent said solid debris transferring opening, a pair of spaced apart baffles disposed adjacent one of said transverse walls and extending generally parallel to the axis of said rotary brush, said baffles extending inwardly from said transverse walls and being arranged in close running clearance with the periphery of said rotary brush and being disposed between said fluid receiving port and said work surface exposing opening.

2. The floor maintenance apparatus as defined in claim 1 being particularly characterized in that filter means are mounted within said separation chamber and interpose a filter barrier between said fluid receiving port and said vacuum means.

3. The floor maintenance apparatus as defined in claim 1 being particularly characterized in that said rotary brush is mounted within said brush receiving enclosure with the periphery thereof being arranged for free-floating contact with the work surface being treated.

4. The floor maintenance apparatus as defined in claim 3 wherein flexible seals are provided along the base of a first of said side walls, and wherein the end of said rotary maintenance tool is disposed immediately adjacent said first side wall seal.

5. The floor maintenance apparatus as defined in claim 1 wherein flexible seals are provided about the entire periphery of said work surface exposing opening.

6. The floor maintenance apparatus as defined in claim 5 being particularly characterized in that filter means having a certain predetermined area are mounted within said separation chamber and interpose a filter barrier between said fluid receiving port and said vacuum means, and wherein the volume of air passing through said filter means is approximately ½ cubic foot per minute per inch of said flexible peripheral seal.

7. Floor maintenance apparatus having a floor treating means including rotary brush means operatively coupled thereto and comprising, in combination:

a. a frame structure having support wheels coupled thereto, housing means coupled to said frame and defining a brush receiving enclosure with said enclosure having walls including a pair of opposed side walls arranged laterally of said enclosure, a solid debris receiving chamber in communication with said brush receiving enclosure, and a source of rotary power mounted on said frame and having a powered output shaft;

b. rotary brush suspension means coupled to said frame for journaled support of said rotary brush therewithin, said brush suspension means including first and second generally longitudinally extending laterally disposed support arms secured to said frame and being disposed adjacent said opposed side walls;

c. drive means coupled to said powered output shaft for imparting rotary motion to said rotary brush;

d. solid-air separation chamber means being provided to remove dust from dust-ladened air, and vacuum means in communication with said separation chamber and interposed between said separation chamber and ambient, conduit means extending between a port formed in said separation chamber and said vacuum means for establishing fluid communication between said separation chamber and said vacuum means, said solid-air separation chamber means being in communication with said brush receiving enclosure through a fluid receiving port formed in a wall of said brush receiving enclosure;

e. said brush receiving enclosure generally comprising an enclosed sector having generally closed ends and transverse walls and including a top wall and said opposed side walls with a bottom opening to define a work surface exposing opening, a solid debris transferring opening formed in one of said transverse walls for transfer of solid debris from said brush receiving enclosure to said solid debris receiving chamber disposed adjacent said solid debris transferring opening, a first baffle and an auxilliary baffle being arranged along a wall of said brush receiving enclosure, with said baffles being arranged along the rear edge of said work surface exposing opening, with said first baffle and said auxilliary baffle being arranged in spaced said fluid receiving port, said first baffle and auxilliary baffle each extending generally parallel to the axis of said rotary brush.

8. Floor maintenance apparatus having a floor treating means including rotary brush means operatively coupled thereto and comprising, in combination:

a. a frame structure having support wheels coupled thereto, housing means coupled to said frame and defining a brush receiving enclosure with said enclosure having walls including a pair of opposed side walls arranged laterally of said enclosure, a solid debris receiving chamber in communication with said brush receiving enclosure, and a source of rotary power mounted on said frame and having a powered output shaft;

b. rotary brush suspension means coupled to said frame for journaled support of said rotary brush therewithin, said brush suspension means including first and second generally longitudinally extending laterally disposed support arms secured to said frame and being disposed adjacent said opposed side walls;

c. drive means coupled to said powered output shaft for imparting rotary motion to said rotary brush along a normal rotational direction; d. solid-air separation chamber means being provided to remove dust from dust-ladened air, and vacuum means in communication with said separation chamber and interposed between said separation chamber and ambient, conduit means extending between a port formed in said separation chamber and said vacuum means for establishing fluid communication between said separation chamber and said vacuum means, said solid-air separation chamber means being in communication with said brush receiving enclosure through a fluid receiving port formed in a wall of said brush receiving enclosure;

e. said brush receiving enclosure generally comprising an enclosed sector having generally closed ends and transverse walls and including a top wall and said opposed side walls with a bottom opening to define a work surface exposing opening, a solid debris transferring opening formed in one of said transverse walls for transfer of solid debris from said brush receiving enclosure to said solid debris receiving chamber disposed adjacent said solid debris transferring opening, a baffle disposed adjacent one of said transverse walls and extending generally parallel to the axis of said rotary brush and being interposed between said fluid receiving port and said work surface exposing opening;

f. flexible seals being arranged in depending relationship from at least one wall of said brush receiving enclosure and disposed about the periphery of said work surface exposing opening, said flexible seals comprising skirt means coupled to said wall means and extending generally adjacent the periphery of at least one wall for isolating at least a portion of said brush receiving enclosure from ambient, said skirt means including a plurality of generally parallelly disposed spaced apart sealing elements cooperatively arranged to define at least one sealing chamber between adjacent sealing elements, and at least one opening being formed through that certain sealing element disposed along and adjacent said brush receiving enclosure to provide gaseous fluid communication between said floor treating means enclosure and said sealing chamber.

9. The floor maintenance apparatus as defined in claim 8 being particularly characterized in that said skirt means is disposed adjacent said baffle.

* * * * *

UNITED STATES PATENT OFFICE

CERTIFICATE OF CORRECTION

PATENT NO. : 3,979,789

DATED : September 14, 1976

INVENTOR(S) : Ralph C. Peabody and Robert D. Hennessey

It is certified that error appears in the above-identified patent and that said Letters Patent are hereby corrected as shown below:

Column 4, line 56, "contacat" should read -- contact --.

Column 6, line 49, "derive" should read -- drive --.

Column 7, line 3, "dispoed" should read -- disposed --.

Column 8, line 61, "upwrd" should read -- upward --.

Column 11, line 41, "flow" should read -- low --.

Column 13, line 57, in Claim 7, sub-paragraph e, after the word "spaced" insert -- relationship adjacent --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*